US008322566B2

(12) United States Patent
Hackett

(10) Patent No.: US 8,322,566 B2
(45) Date of Patent: Dec. 4, 2012

(54) LOCK BOX WITH SLIDING LID

(75) Inventor: Jason O. Hackett, Canton, GA (US)

(73) Assignee: Panduit Corp., Tinley Park, IL (US)

( * ) Notice: Subject to any disclaimer, the term of this patent is extended or adjusted under 35 U.S.C. 154(b) by 343 days.

(21) Appl. No.: 12/335,119

(22) Filed: Dec. 15, 2008

(65) Prior Publication Data

US 2010/0147853 A1 Jun. 17, 2010

(51) Int. Cl.
*B65D 43/14* (2006.01)
*B65D 50/04* (2006.01)

(52) U.S. Cl. ..... 220/812; 220/811; 220/345.4; 206/1.5

(58) Field of Classification Search ..... 220/315, 220/345.1, 345.2, 4.02, 810–813; 206/1.5; 70/63, 14; 211/9
See application file for complete search history.

(56) References Cited

U.S. PATENT DOCUMENTS

| | | | | |
|---|---|---|---|---|
| 2,277,618 | A * | 3/1942 | Utter | 220/324 |
| 3,179,759 | A | 4/1965 | Rice et al. | |
| 3,422,988 | A * | 1/1969 | LaFranca | 221/58 |
| 3,590,614 | A | 7/1971 | Kunst | |
| 3,955,709 | A * | 5/1976 | Coley et al. | 220/812 |
| 4,260,069 | A | 4/1981 | Juergens | |
| 4,452,371 | A | 6/1984 | Jurek | |
| 4,470,518 | A | 9/1984 | Stein | |
| 4,496,050 | A | 1/1985 | Kirchner et al. | |
| 4,502,609 | A | 3/1985 | Christatos | |
| 4,775,075 | A | 10/1988 | Kamin et al. | |
| 4,909,579 | A * | 3/1990 | Liu | 312/223.2 |
| 5,673,811 | A | 10/1997 | Dickinson et al. | |
| 5,878,613 | A | 3/1999 | Tabacchi et al. | |
| 5,996,831 | A | 12/1999 | Teok | |
| 6,116,452 | A | 9/2000 | Hamel et al. | |
| 6,240,750 | B1 | 6/2001 | Gillespie et al. | |
| 6,478,160 | B1 | 11/2002 | Au et al. | |
| 6,730,845 | B1 * | 5/2004 | Criniti et al. | 174/67 |
| 7,220,148 | B2 | 5/2007 | Zhao et al. | |
| 7,360,380 | B2 * | 4/2008 | Van Handel | 70/63 |
| 2002/0162367 | A1 | 11/2002 | Oliver | |
| 2005/0199628 | A1 | 9/2005 | Van Handel et al. | |
| 2006/0042331 | A1 | 3/2006 | Benda | |
| 2006/0162403 | A1 | 7/2006 | Handel | |

FOREIGN PATENT DOCUMENTS

| | | |
|---|---|---|
| CH | 622153 | 9/1987 |

* cited by examiner

*Primary Examiner* — Mickey Yu
*Assistant Examiner* — Chun Cheung
(74) *Attorney, Agent, or Firm* — Robert A. McCann; Christopher S. Clancy; Aimee E. McVady

(57) ABSTRACT

The present invention is directed to a secured group lock box. The group lock box includes a body having a latch and a lid connected to the body. The lid includes a main member and a back member. The main member of the lid includes a plurality of slots and the back member of the lid includes a plurality of pins. One of the pins is installed in each of the slots for enabling the main member of the lid to slidingly extend over the body of the group lock box before the lid is rotated away from the body to provide access to the contents therein.

7 Claims, 11 Drawing Sheets

LOCK BOX WITH SLIDING LID

FIELD OF THE INVENTION

The present invention relates to a group lock box, and more particularly to a group lock box having a sliding lid.

BACKGROUND OF THE INVENTION

Group lock boxes are used when multiple employees work on the same machine or the same equipment. After a machine is locked, the machine keys are placed in the group lock box. Each employee secures their personal padlock along the sides of the group lock box to ensure that no one employee can have access to the machine keys in the box unless all the employees remove their individual padlocks. A main padlock is typically placed at the front of the group lock box. When the main padlock is removed, the group lock box with the plurality of individual padlocks generally prevents access to the keys inside the box. However, in some current lock box designs, the lock box lid may be partially raised when the main padlock has been removed thereby providing access to the machine keys inside the group lock box.

Therefore, it is desirable to provide a group lock box where no individual employee has access to the machine keys in the box unless all of the employees have removed their individual pad locks. It is also desirable to provide an improved group lock box that eliminates security issues with current lock box designs.

SUMMARY OF THE INVENTION

The present invention is directed towards a group lock box having a body and a lid pivotally connected to the body. The body includes a latch extending outwards from the front of the body. The lid includes a main member and a back member. The main member includes a plurality of slots and the back member includes a plurality of pins. One of the pins is installed in each of the slots for enabling the main member of the lid to slidingly extend over the latch on the body. Once the main member is over the latch, the main member may be rotated away from the body providing access inside the lock box.

DETAILED DESCRIPTION

Figure 1:
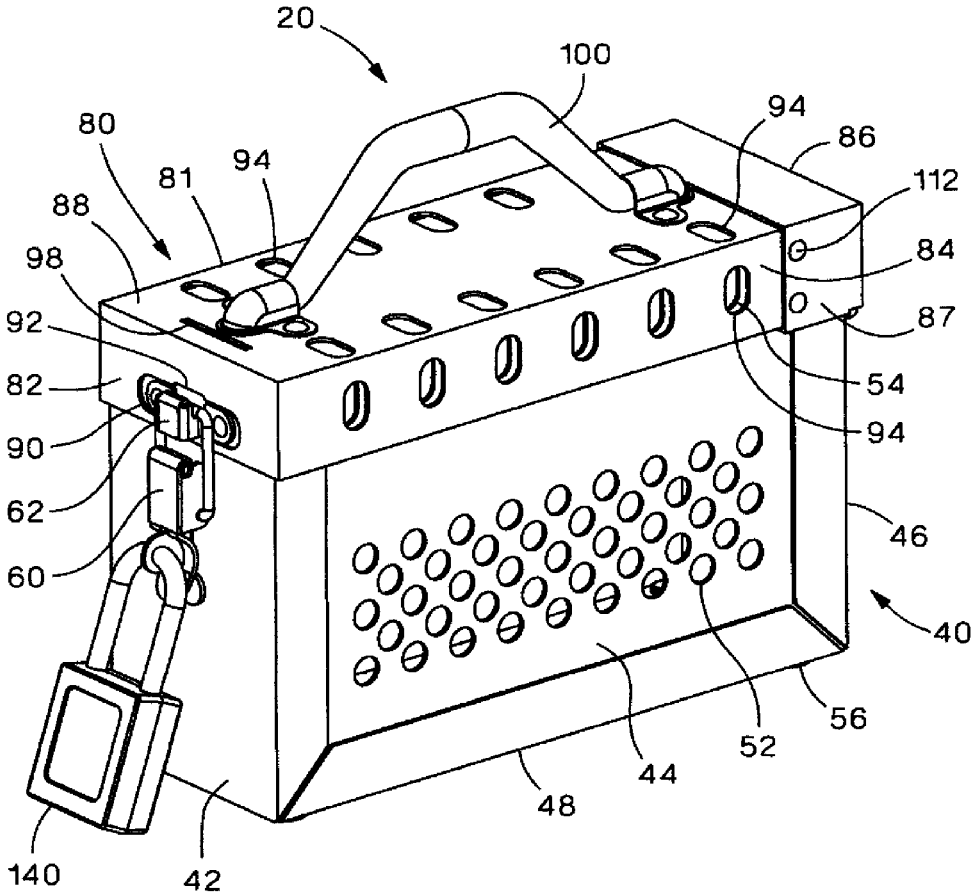
FIG. 1 is a front perspective view of the group lock box of the present invention.

FIG. 1 illustrates a group lock box of the present invention. The group lock box 20 includes a body 40 and a lid 80. The body 40 includes a front 42, sides 44, a back 46 and a bottom 48. The front 42, sides 44, back 46 and bottom 48 define a storage compartment 50 therein. As illustrated in FIG. 1, the lid 80 is designed to be positioned over the body 40 of the box 20 to close the storage compartment 50.

At least one side 44 of the body 40 includes a plurality of circular holes 52 for ventilation. The top 45 of the sides 44 of the body 40 also include a plurality of padlock holes 54 or openings. The padlock holes 54 are generally oval shape and extend vertically at the top 45 of the sides 44. The padlock holes 54 are able to receive various sized padlocks installed by each employee.

Figure 2A:
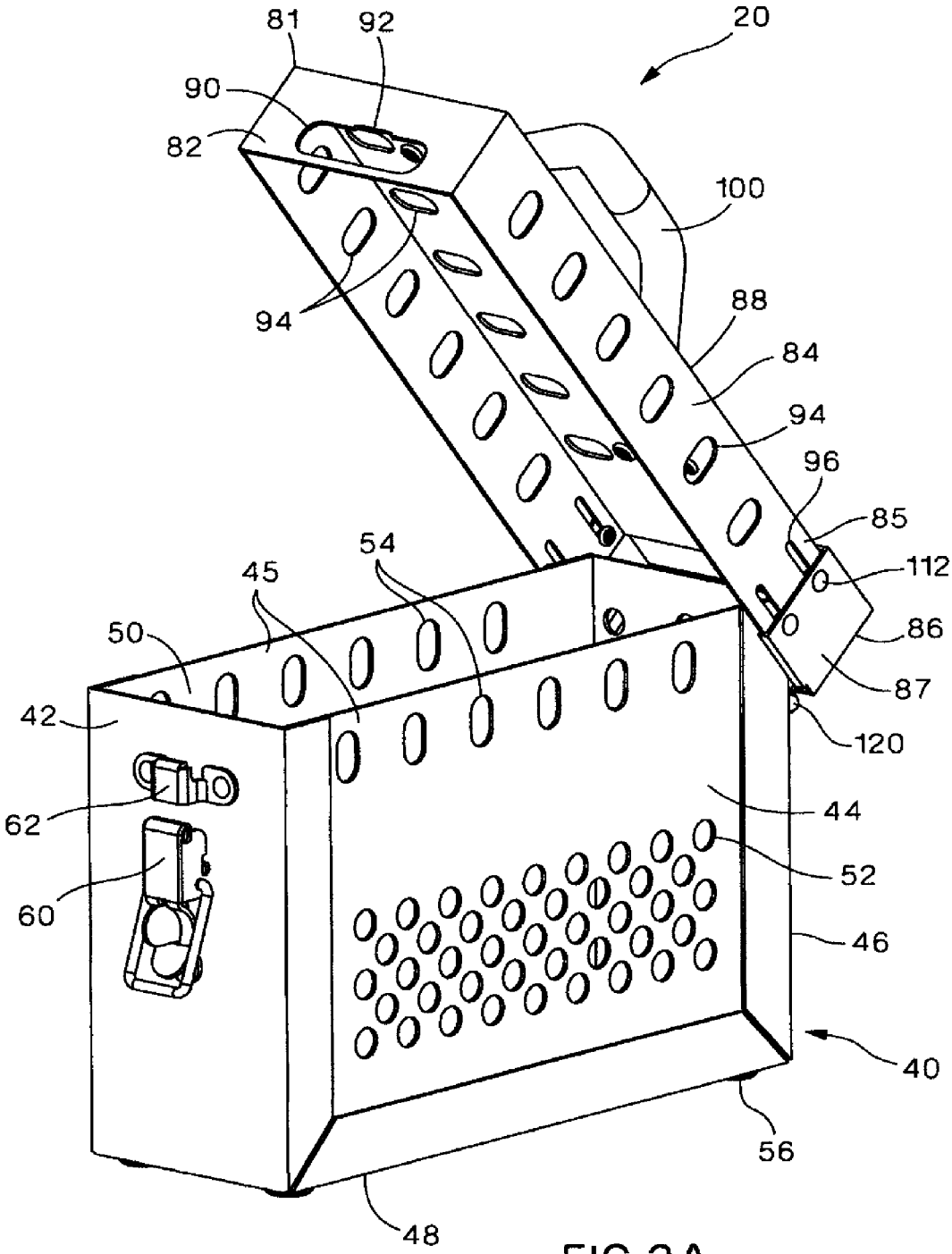
FIG. 2A is a front perspective view of the group lock box of FIG. 1 with the lid lifted.

As illustrated in FIG. 2A, the bottom 48 of the body 40 also includes a plurality of feet 56.

A standard draw latch 60 is secured to the front 42 of the body 40. As shown in FIG. 2A, the draw latch 60 is positioned at or near the center of the front 42 of the body 40. The draw latch 60 includes a latch catch 62 or retaining feature for preventing the lid 80 from being lifted.

The lid 80 includes a main member 81 having a front 82, sides 84 and a top 88. The lid 80 also includes a back member 86. As shown in FIGS. 1 and 2A, the front 82 of the lid 80 includes a latch catch opening 90. The latch catch opening 90 is a generally oval shaped opening with an extended portion 92 at the center of the oval opening. As discussed below, the oval opening 90 with the extended portion 92 are sized to slide over the latch catch 62 without engaging the latch catch 62.

The top 88 of the lid 80 and each side 84 of the lid 80 includes a plurality of padlock holes 94 or openings. The padlock holes 94 are generally oval shaped. The padlock holes 94 along the side extend vertically and the padlock holes 94 in the top 88 of the lid 80 extend horizontally across the lid. Thus, as discussed below, the padlock holes 94 in the lid 80 align with the padlock holes 54 in the body 40 when the lid 80 is positioned over the body 40.

Figure 2B:
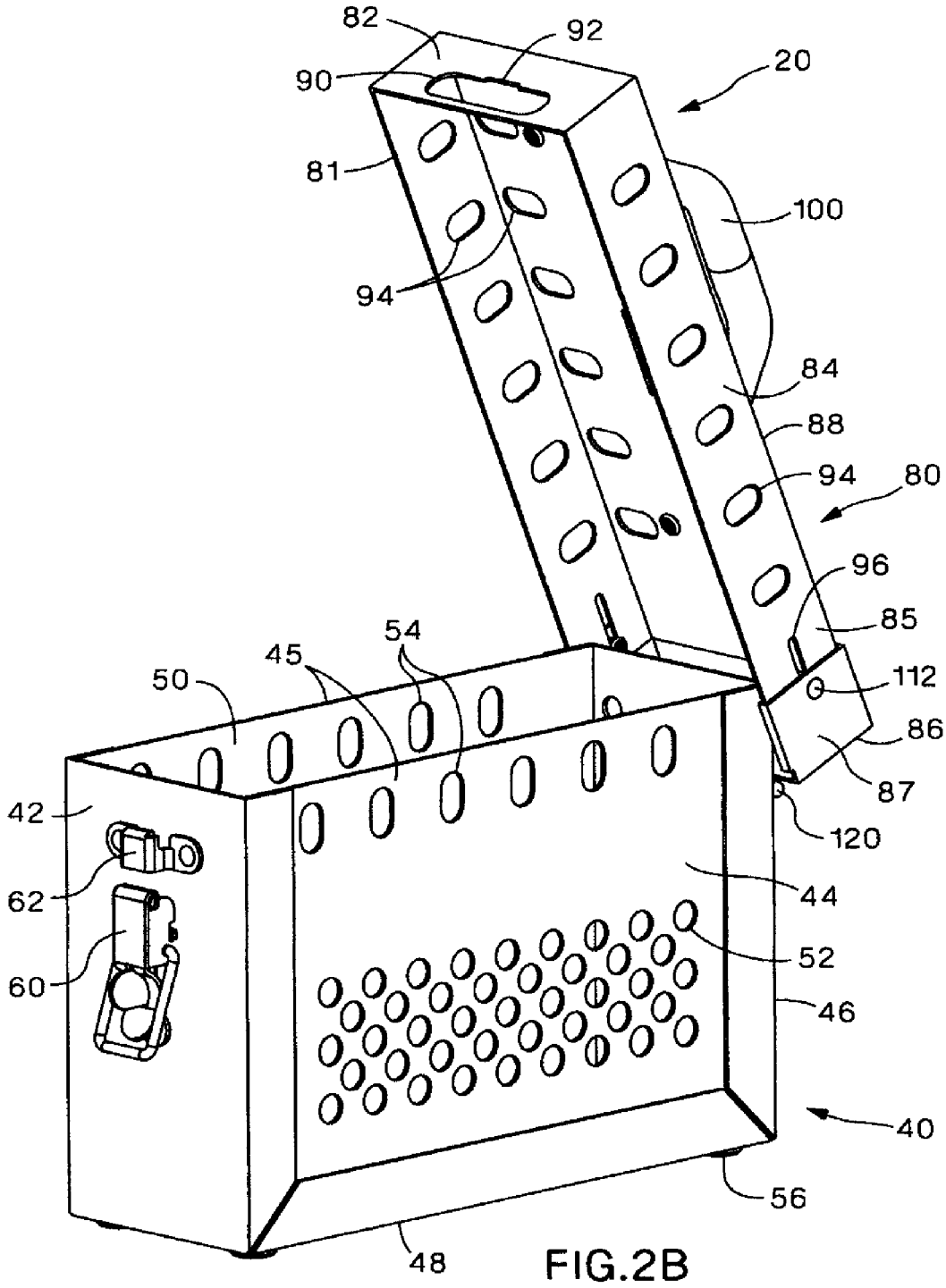
FIG. 2B is a front perspective view of a second embodiment of the group lock box of FIG. 1 with the lid lifted.

Each side 84 of the lid 80 also includes one or more slots 96 positioned towards the back 85 of each side 84. The slots 96 extend horizontally along the length of each side 84. As illustrated in FIG. 2A, each side 84 includes two slots 96 that are positioned adjacent each other at the back 85 of the side 84. Although each side 84 is illustrated with two slots 96, the number and size of the slots may vary. For example, as illustrated in FIG. 2B, each side 84 of the lid 80 includes one slot 96 positioned towards the back 85 of each side 84.

As illustrated in FIG. 1, the top 88 of the lid 80 also includes a rectangular slot 98 for receiving the machine keys and a handle 100. The rectangular slot 98 may be located towards the front 82 of the lid 80 as illustrated, or in the center of the lid 80 under the handle 100, if desired.

Figure 5:
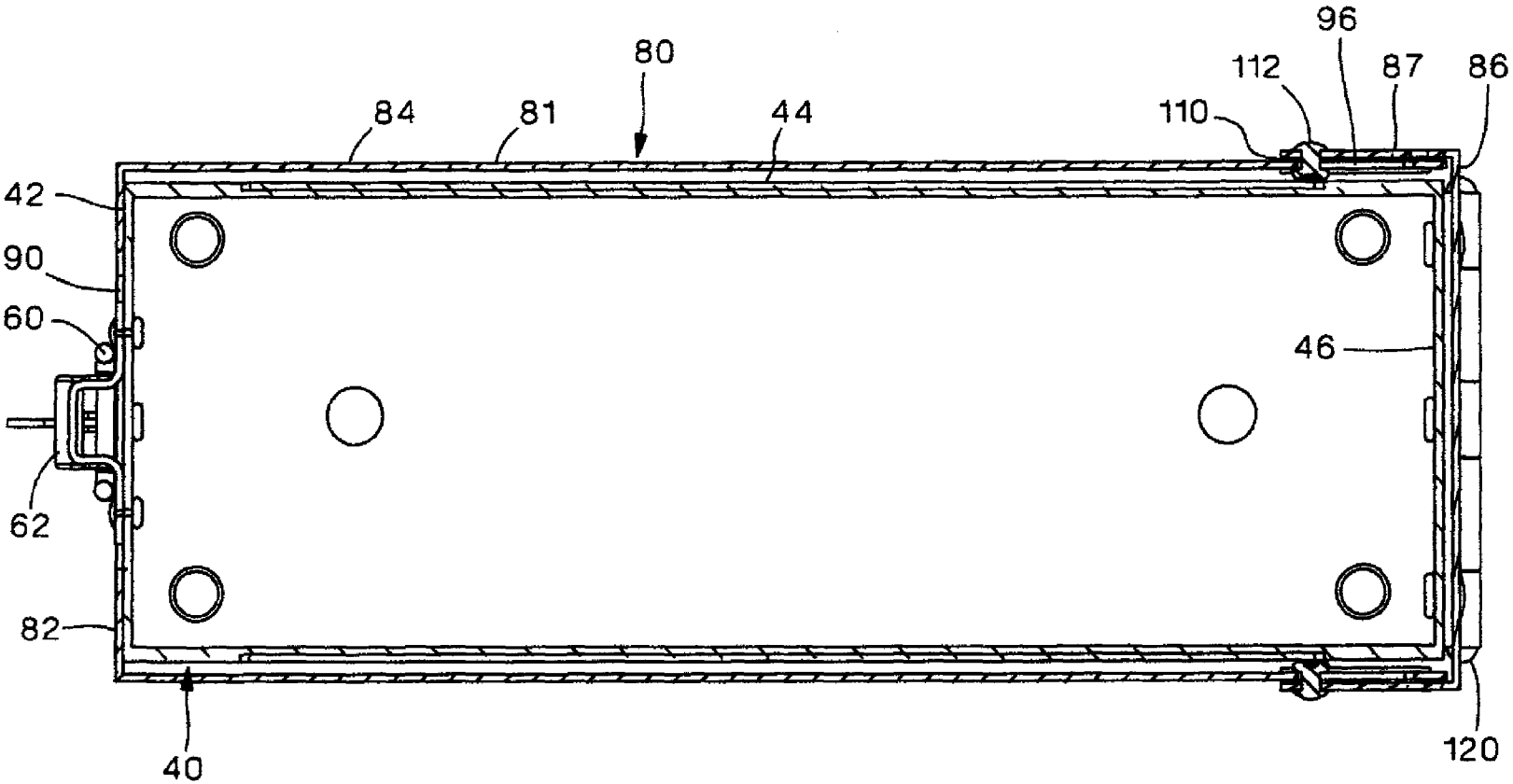
FIG. 5 is a cross sectional view of the group lock box of FIG. 4 taken along line 5-5.

The back member 86 of the lid 80 receives the sides 84 and the top 88 of the lid 80. More specifically, as illustrated in FIG. 5, the back member 86 includes a channel 110 designed to receive the sides 84 of the lid 80. As described below, the back member 86 also includes one or more pins 112 that are disposed in the slots 96 that extend along the sides 84 of the lid 80 for enabling the main member 81 of the lid 80 to slide into an extended position with respect to the back member 86 and the body 40.

Figure 3:
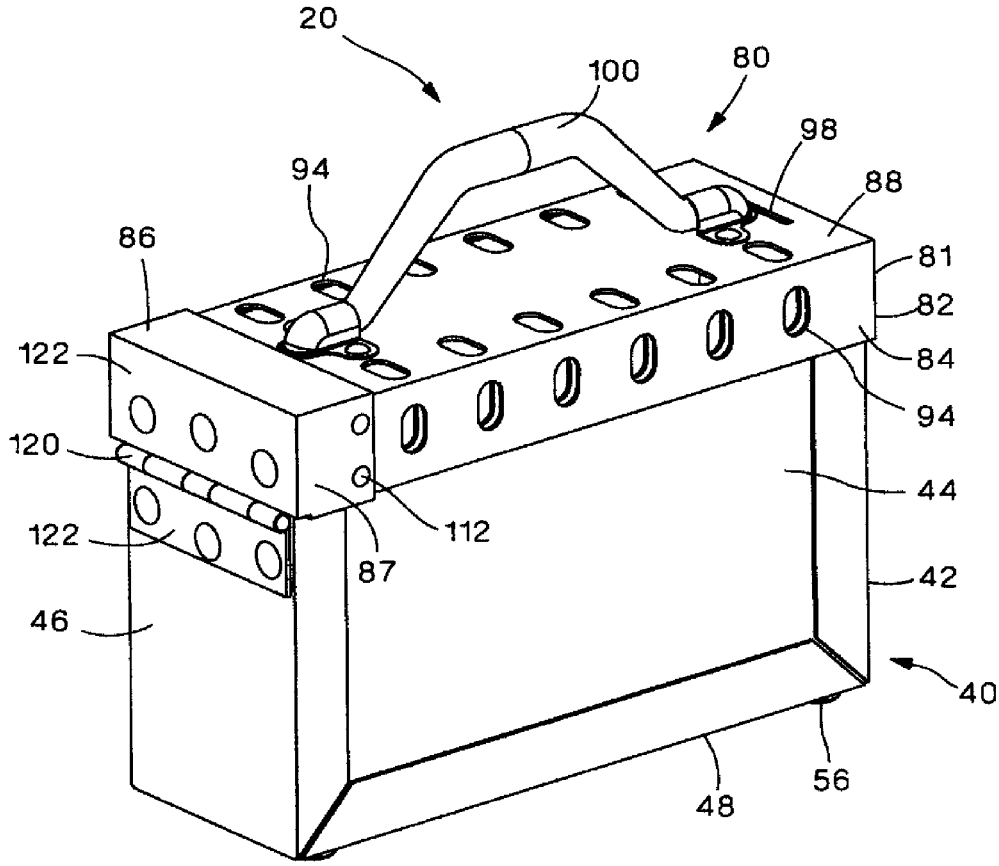
FIG. 3 is a rear perspective view of the group lock box of FIG. 1.

As illustrated in FIG. 3, the back 46 of the box 20 includes a hinge 120. A plate 122 of the hinge 120 is secured to the back 46 of the body 40 and a plate 122 of the hinge 120 is secured to the back member 86 of the lid 80 to hingedly connect the lid 80 to the body 40.

Figure 4:
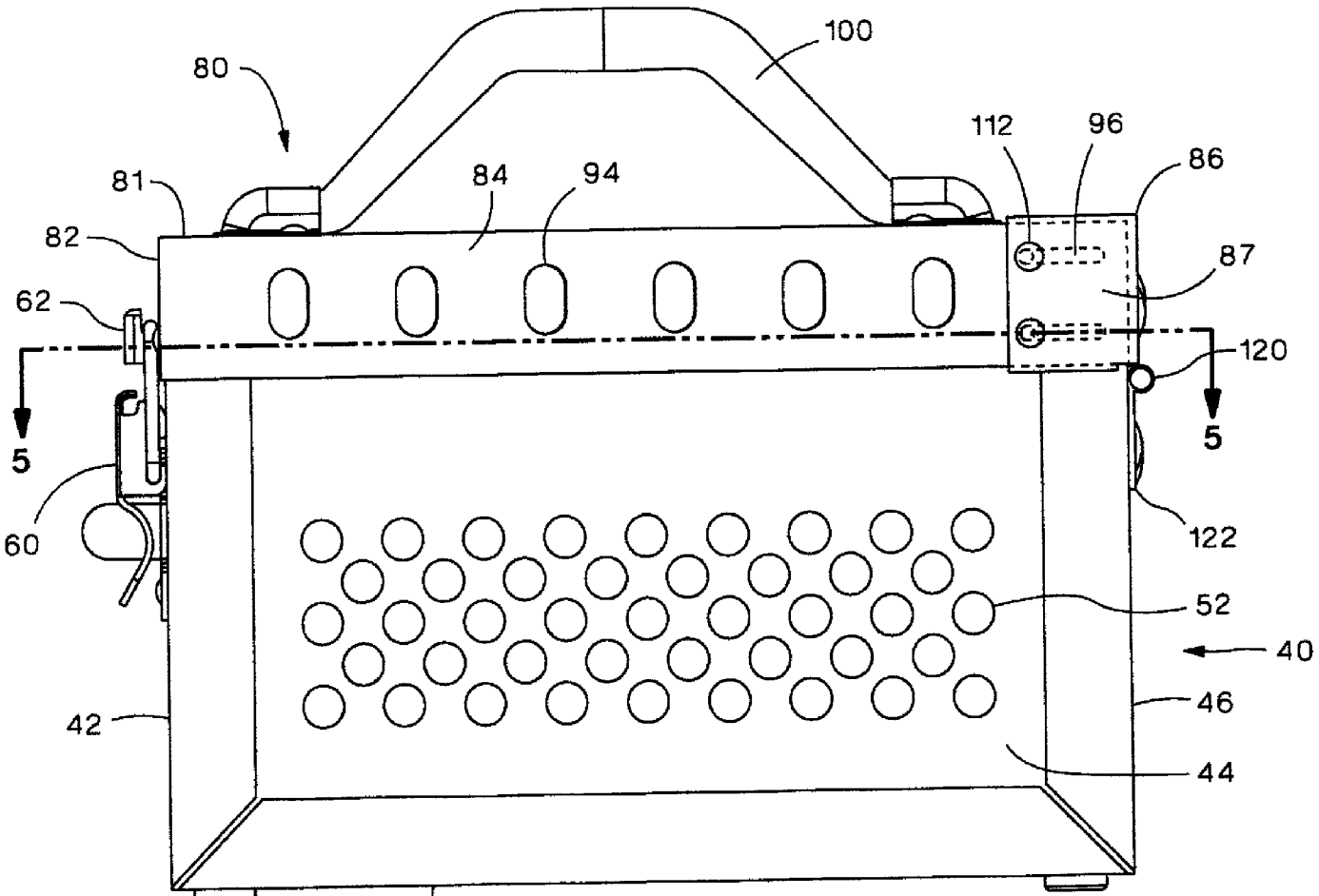
FIG. 4 is a side view of the group lock box of FIG. 1.

As illustrated in FIGS. 4-5, the lid 80 is positioned on the body 40 to close the storage compartment 50 therein. The padlock openings 54 and 94 are aligned to receive the employee padlocks 142 to secure the group lock box 20. The latch catch extends from the front of the body and out the latch catch opening of the lid 80. The standard draw latch 60 is secured over the latch catch 62. As a result, the lid 80 is prevented from swinging open and providing access inside the box.

FIG. 5 illustrates a cross sectional view of the connection of the back member 86 with the sides 84 of the lid 80. As discussed above and illustrated in FIG. 4, the back 85 of the sides 84 of the lid 80 include adjacent slots 96 that extend horizontally along the length of the sides 84. The back 85 of each side 84 is positioned in the channel 110 formed by the sides 87 of the back member 86. Pins 112 are positioned in the sides of the back member 86 such that they extend through the slots 96 in the sides 84 of the lid 80. The pins 112 slide in the slots 96 enabling the lid 80 to extend from the back member 86 over the front 42 of the body 40 and the attached latch catch 62.

Figure 6:
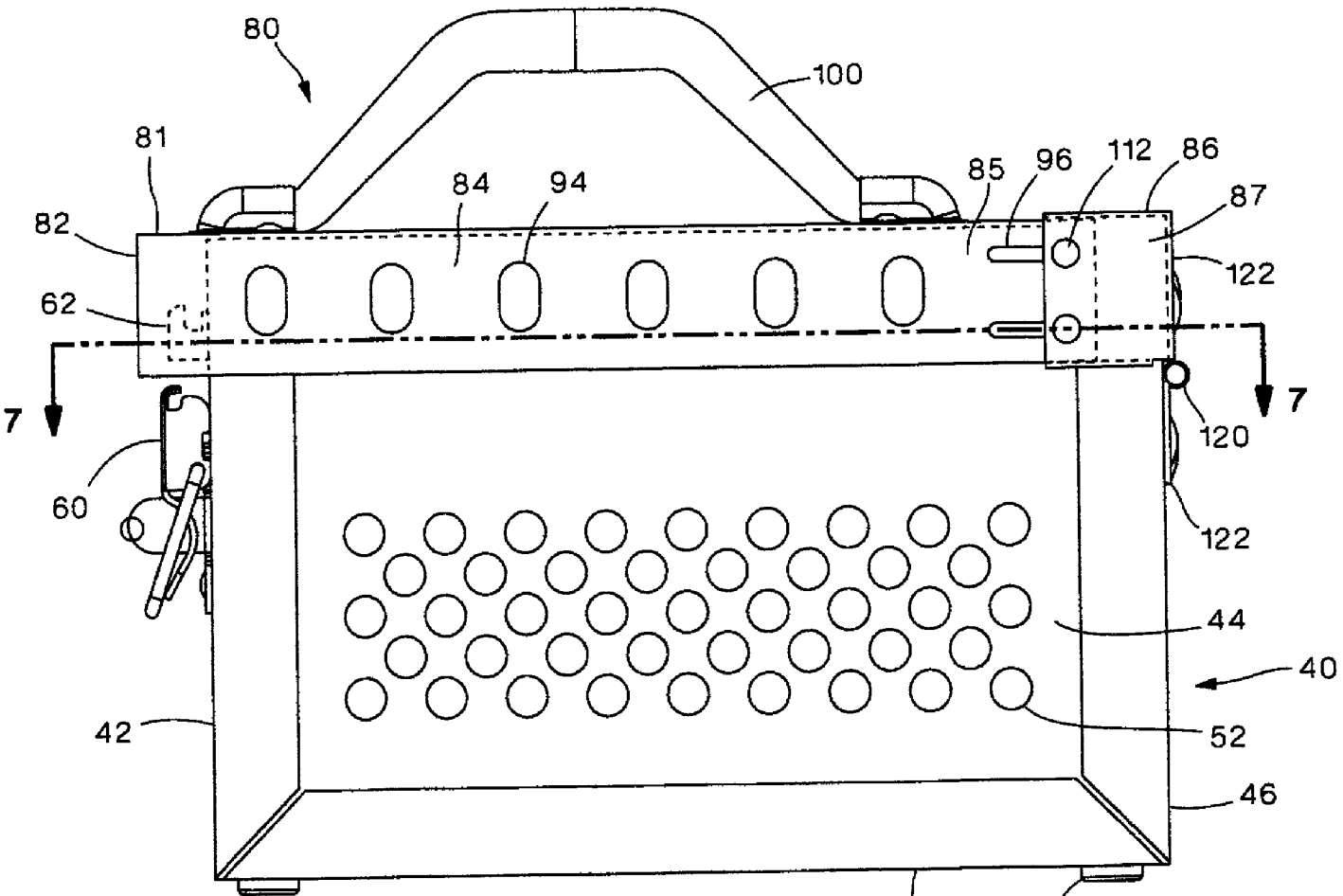
FIG. 6 is a side view of the group lock of FIG. 1 with the lid extended.
Figure 7:
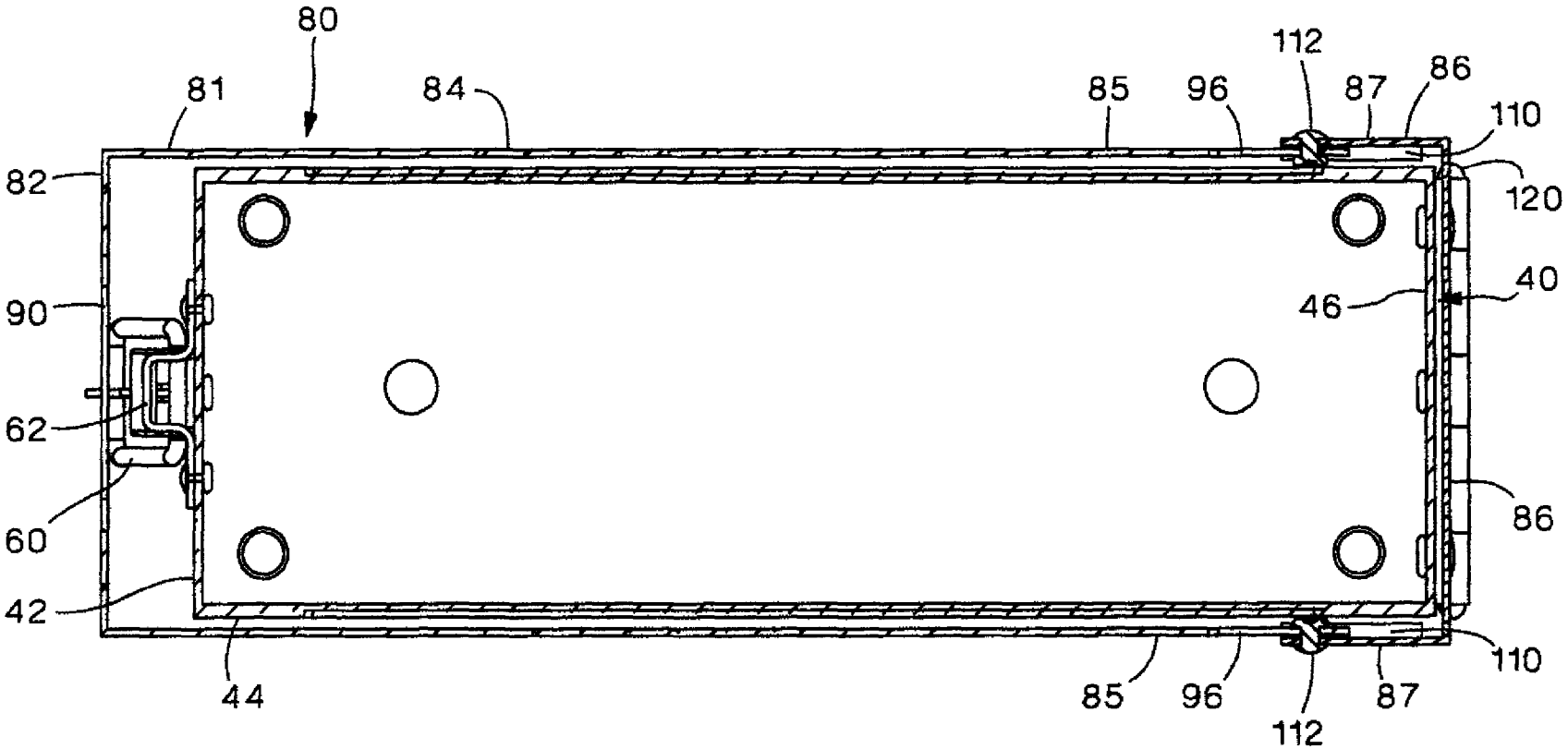
FIG. 7 is a cross sectional view of the group lock box of FIG. 6 taken along line 7-7.
Figure 8:
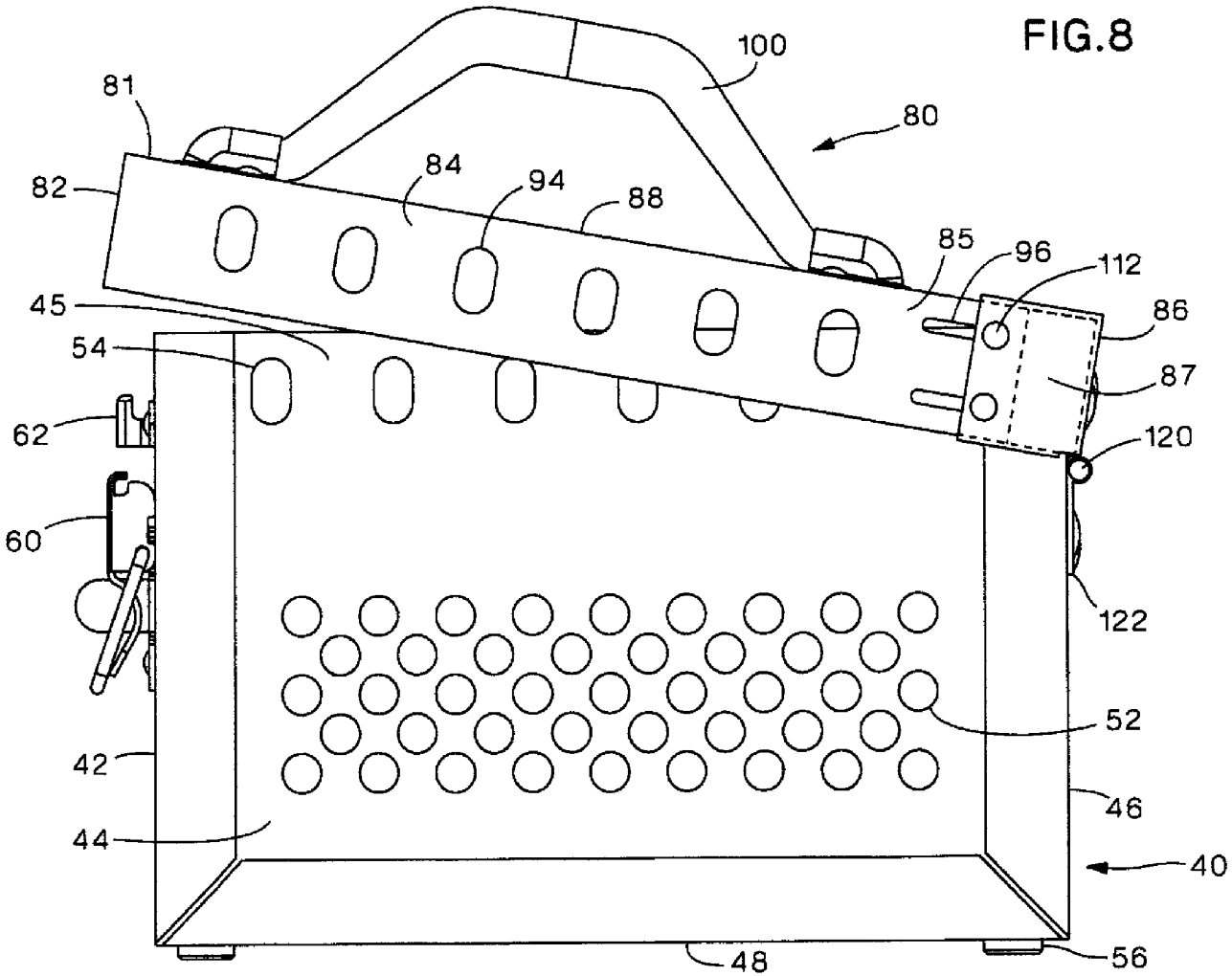
FIG. 8 is a side view of the group lock box of FIG. 6 with the lid extended and lifted.

As illustrated in FIGS. 6-8, to provide access to the storage compartment 50, the lid 80 must first be extended before it can be lifted off of the body 40. FIG. 6 illustrates the lid 80 extended such that the lid 80 is positioned over the latch catch 62. The pins 112 are now positioned at the opposite end of the slot 96. Once the latch catch opening 90 receives the latch catch 62, the lid 80 may be lifted off of the body 40. As a result, as illustrated in FIG. 8, the lid 80 may be rotated away from the body 40 of the lock box 20 to provide access inside the lock box 20. Thus, the latch catch 62 prevents the lid 80 from sliding open when no locks are in place. The latch catch 62 also prevents the lid 80 from being partially lifted creating a gap for a key to be removed before the padlocks 142 are removed.

Figure 9:
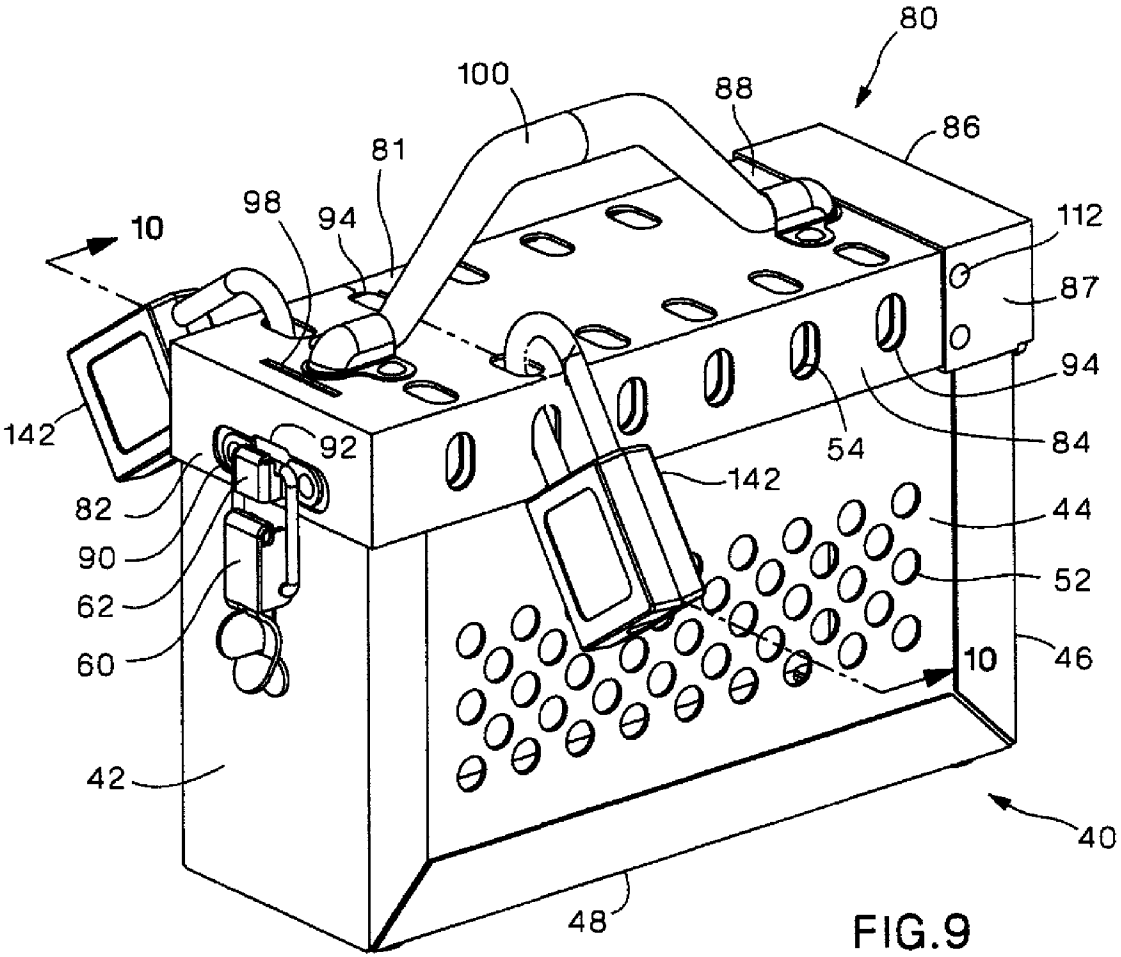
FIG. 9 is a front perspective view of the group lock box of FIG. 1 with padlocks installed along the sides of the lock box.
Figure 10:
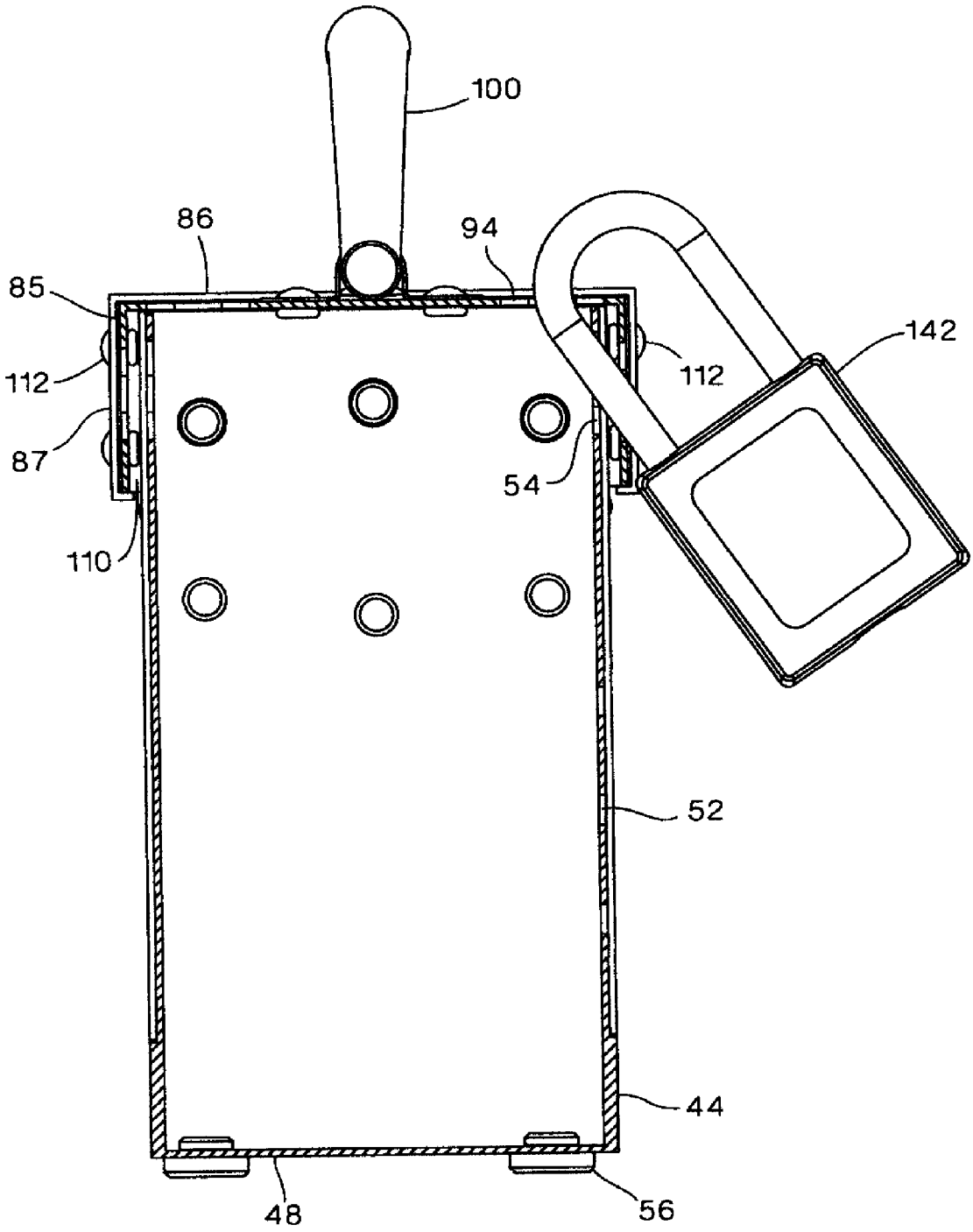
FIG. 10 is a cross sectional view of the group lock box of FIG. 9 taken along line 10-10.

As illustrated in FIGS. 9-10, the padlock openings 94 in the sides 84 of the lid 80 and the padlock openings 54 in the body 40 are aligned when the lock box 20 is closed. As a result, a plurality of padlocks 142 may be installed through the holes 94 in the top 88 of the lid 80 and the aligned set of holes 54, 94 in the body 40 and sides 84 of the lid 80, respectively. The padlocks secure the contents of the group lock box to help ensure access to the lock box is available only after all employees have removed their padlocks.

Therefore, the group lock box of the present invention provides increased security by preventing access to the lock box before all employee padlocks have been removed.

Furthermore, while the particular preferred embodiments of the present invention have been shown and described, it will be obvious to those skilled in the art that changes and modifications may be made without departing from the teaching of the invention. The matter set forth in the foregoing description and accompanying drawings is offered by way of illustration only and not as limitation. The actual scope of the invention is intended to be defined in the following claims when viewed in their proper perspective based on the prior art.

The invention claimed is:

1. A group lock box for securing machine keys therein, the group lock box comprising:

a body having a bottom, sides, a front having a locking mechanism, and a back defining a storage compartment for holding machine keys;

a lid covering the body, wherein the lid having a back member secured to the body and a main member slidably connected to the back member;

the back member having a first end with at least one pin and a second end pivotally connected to the body; and the main member having a front with a latch opening, a first end and a second end with at least one slot that receives the at least one pin of the back member, wherein the main member extends from a first position with the second end disposed within the back member and covering the body to a second position extending beyond the locking mechanism on the front of the body.

2. The group lock box of claim 1, wherein the main member of the lid includes a front, a top and sides, wherein the at least one slot is along the sides at the second end of the main member.

3. The group lock box of claim 1, wherein the back member includes a channel for receiving the main member of the lid.

4. The group lock box of claim 3, wherein the at least one slot of the main member is positioned in the channel and the at least one pin extends through the channel.

5. The group lock box of claim 1, wherein the locking mechanism includes a latch to secure the lock box in a closed positioned and wherein the main member slidingly extends beyond the latch to enable the lid to be lifted off of the body to an open position.

6. The group lock box of claim 1, wherein the body includes a plurality of openings for receiving a padlock and the lid includes a plurality of openings for receiving a padlock, whereby the plurality of openings align when the lid is positioned over the body.

7. The group lock box of claim 1, wherein the locking mechanism includes a latch and a catch.

* * * * *